US011035653B2

(12) United States Patent
Bandini

(10) Patent No.: US 11,035,653 B2
(45) Date of Patent: Jun. 15, 2021

(54) METAL CARTRIDGE FOR AMMUNITION AND METHOD OF MAKING IT

(71) Applicants: PBM Limited, Mellieha (MT); Nicola Bandini, Colle di Val d'Elsa (IT)

(72) Inventor: Nicola Bandini, Colle di Val d'Elsa (IT)

(73) Assignees: Nicola Bandini, Colle di Val d'Elsa (IT); PBM Limited, Mellieha (MT)

( * ) Notice: Subject to any disclaimer, the term of this patent is extended or adjusted under 35 U.S.C. 154(b) by 0 days.

(21) Appl. No.: 15/733,559

(22) PCT Filed: Feb. 14, 2019

(86) PCT No.: PCT/EP2019/053630

§ 371 (c)(1),
(2) Date: Aug. 27, 2020

(87) PCT Pub. No.: WO2019/166226

PCT Pub. Date: Sep. 6, 2019

(65) Prior Publication Data

US 2020/0408492 A1 Dec. 31, 2020

(30) Foreign Application Priority Data

Feb. 27, 2018 (IT) ..... 102018000003077

(51) Int. Cl.
*F42B 5/285* (2006.01)

(52) U.S. Cl.
CPC ..... *F42B 5/285* (2013.01)

(58) Field of Classification Search
CPC ..... F42B 5/26; F42B 5/28; F42B 5/285
See application file for complete search history.

(56) References Cited

U.S. PATENT DOCUMENTS 2,294,822 A * 9/1942 Albree ..... F42B 5/285 102/469
2,402,068 A 6/1946 Meador
(Continued)

FOREIGN PATENT DOCUMENTS

DE 2 201 494 7/1973
FR 2 266 868 10/1975
(Continued)

OTHER PUBLICATIONS

International Search Report issued in corresponding International Patent Application No. PCT/EP2018/053630 dated Mar. 8, 2019.

*Primary Examiner* — J. Woodrow Eldred
(74) *Attorney, Agent, or Firm* — Troutman Pepper Hamilton Sanders LLP

(57) ABSTRACT

A light alloy cartridge for ammunition made by mechanical removal of chips has a front retaining collar for retaining a projectile and a hollow body having a rim at the rear provided with a central primer hole and at the front a shoulder connecting to the collar, the hollow body having an internal surface that bounds a cavity suitable for containing the propellent, the cartridge being formed by a rear element and a front element that are structurally independent, fixed stiffly to one another, the internal surface of the hollow body having at the rim at least one notch configured to increase the volume of the cavity suitable for containing the propellent.

4 Claims, 2 Drawing Sheets

(56) References Cited

U.S. PATENT DOCUMENTS

| | | | | |
|---|---|---|---|---|
| 3,498,221 | A * | 3/1970 | Hilton | B21C 23/20 102/464 |
| 4,147,107 | A | 4/1979 | Ringdal | |
| 4,455,725 | A * | 6/1984 | van Baal | B21D 51/54 86/19.5 |
| 10,132,601 | B2 * | 11/2018 | Nemec | F42B 12/02 |
| 2012/0060716 | A1 | 3/2012 | Davies et al. | |
| 2012/0180688 | A1 | 7/2012 | Padgett | |
| 2018/0058829 | A1 * | 3/2018 | Baxter | F42B 8/04 |

FOREIGN PATENT DOCUMENTS

| | | |
|---|---|---|
| GB | 02762 | 11/1911 |
| GB | 469 370 | 7/1937 |
| GB | 498 080 | 1/1939 |

* cited by examiner

METAL CARTRIDGE FOR AMMUNITION AND METHOD OF MAKING IT

CROSS REFERENCE TO RELATED APPLICATIONS

This is a U.S. National Phase Application under 35 U.S.C. § 371 of International Patent Application No. PCT/EP2019/053630, filed Feb. 14, 2019, which claims priority of Italian Patent Application No. 102018000003077, filed Feb. 27, 2018. The entire contents of which are hereby incorporated by reference.

FIELD OF THE INVENTION

The present invention relates to a metal cartridge for ammunition, particularly for artillery or antiaircraft or anti-tank rifles.

BACKGROUND

A cartridge of this type is generally made up of a front retaining collar for retaining a projectile and a hollow body having a rim at the rear provided with a central primer hole and at the front a shoulder connecting to the collar.

The hollow body bounds a chamber of the propellent necessary for the ejection of the projectile.

A traditional cartridge for ammunition is generally made in a single piece of brass by deep drawn stamping via a transfer press.

A traditional cartridge for ammunition has some disadvantages, including weight, which complicates logistics by limiting the quantities that can be transported in a single lot, especially in the case of air transport.

Moreover, the stamping of the cartridge has some intrinsic technological limits tied to the opening of the punch and die cavity which penalize the internal volume obtainable for the chamber of the propellent.

SUMMARY

The technical task of the present invention is therefore to provide a metal cartridge for ammunition that enables the aforesaid technical drawbacks of the prior art to be overcome.

Within the scope of this technical task, one object of the invention is to provide a metal cartridge for ammunition which has a chamber of the propellent with an increased volume, the caliber being equal.

Another object of the invention is to provide a metal cartridge for ammunition which ensures an increased range of the projectile, the caliber being equal.

Another object of the invention is to provide a metal cartridge for ammunition which has a reduced weight, the caliber being equal.

The technical task, as well as these and other objects, are achieved, according to the present invention, by providing a metal cartridge for ammunition having a front retaining collar for retaining a projectile and a hollow body having a rim at the rear provided with a central primer hole and at the front a shoulder connecting to said collar, said hollow body having an internal surface that bounds a chamber of the propellent, characterized in that it is formed by a rear element and a front element that are structurally independent, fixed stiffly to one another, and in that said internal surface has at said rim at least one notch configured to increase the volume of said chamber of the propellent.

The present invention also discloses a method of making a cartridge for ammunition, characterized in subjecting two light alloy rods to mechanical removal of chips so as to form said rear element of the cartridge and said front element of the cartridge.

Advantageously said two light alloy rods are machined internally and externally.

A solid rod is preferably used to form the rear element and an axially hollow rod to form the front element.

Advantageously, the mechanical removal of chips is designed to impart a greater volume to the chamber of the propellent compared to the starting caliber.

In particular, thanks to the mechanical removal of chips, a cartridge is made in which the collar has an internal diameter that is smaller than the internal diameter of the chamber of the propellent.

The reduction of material by removal of chips, besides increasing the internal volume of the chamber of the propellent, contributes to making the cartridge more lightweight, and this weight reduction effect is added to the one tied to the use of a light alloy, particularly of aluminum, which has the necessary mechanical properties.

The light Al alloy is preferably an alloy having Zn as the main alloying element, and Cu and Mg as other alloying elements.

An alloy used for aeronautical structures having, as alloying elements, Cu with a concentration of between 1.2 and 2.0% by weight, Mg with a concentration of between 2.1 and 2.9% by weight and Zn with a concentration between 5.1 and 6.1% by weight is preferably used.

In particular, use is made of a light alloy, ERGAL™ 7075, which has noteworthy mechanical characteristics, such as, for example, a "mechanical memory", i.e. an elastic modulus, which, for example, the brass traditionally used for cartridges does not have.

An alloy of this type, in other words, returns more or less to the same dimensions as the original ones after firing, unlike brass.

On the other hand, though nearly all other minor aluminum alloys can be stamped like brass, they do not have a mechanical memory and remain deformed after firing, and are thus unusable after the first firing.

An alloy of this type, by contrast, functions like and better than brass, with about half of the weight for the same product.

According to the invention, light alloys of this type which cannot be stamped are machined by removal of chips, it being envisaged to form the cartridge from two pieces which are then securely coupled.

Other features of the present invention are also defined in the claims hereinbelow.

BRIEF DESCRIPTION OF THE DRAWINGS

Additional features and advantages of the invention will become more apparent from the description of a preferred but non-exclusive embodiment of the metal cartridge for ammunition according to the invention, illustrated by way of non-limiting example in the appended drawings, in which.

DETAILED DESCRIPTION OF THE DRAWINGS

Figure 1:
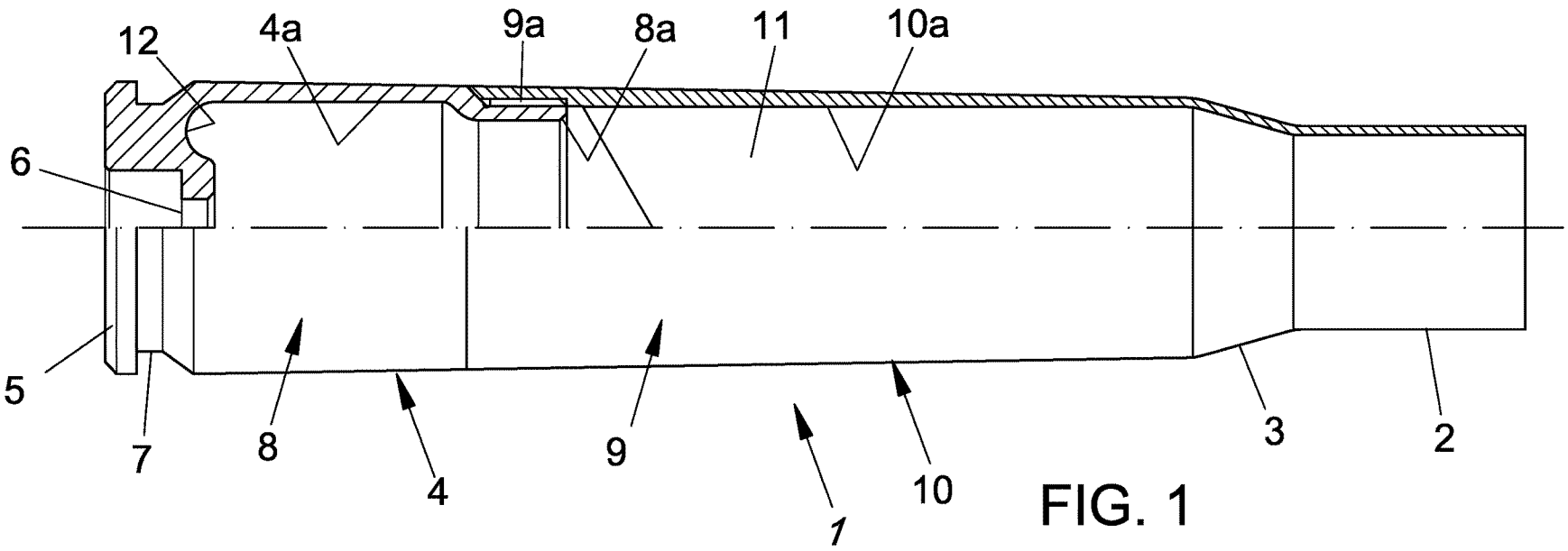
FIG. 1 shows a side elevation view of the cartridge, partially sectioned.
Figure 3:
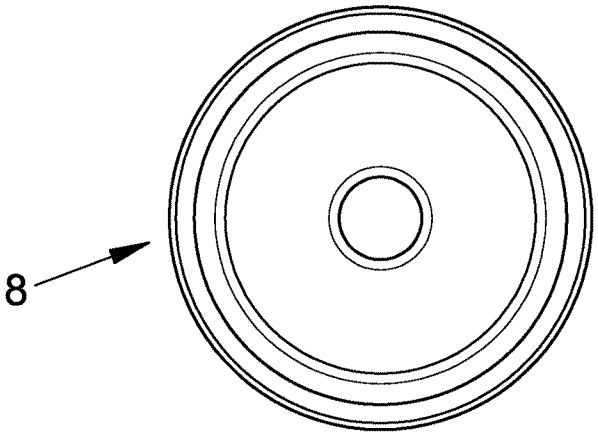
FIG. 3 shows a plan view of the rear element.
Figure 2:
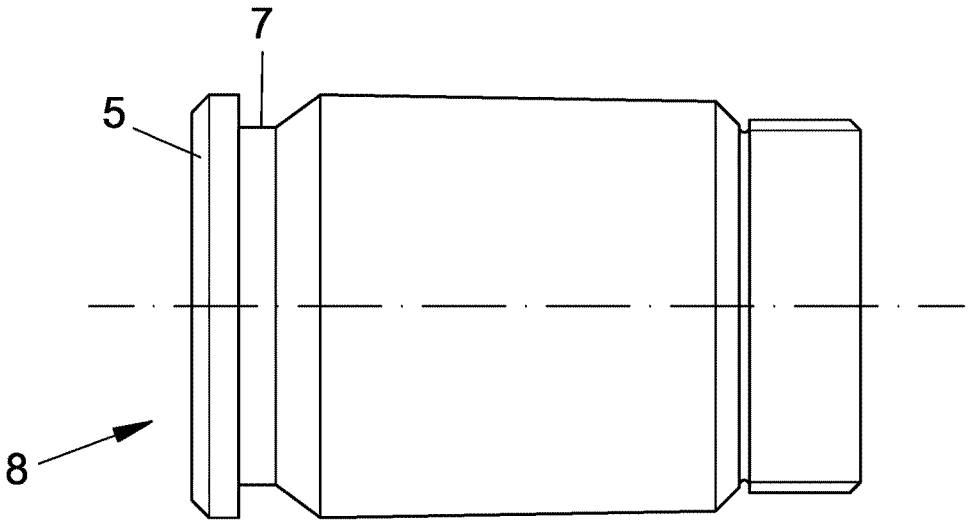
FIG. 2 shows a side elevation view of the rear element.
Figure 4:
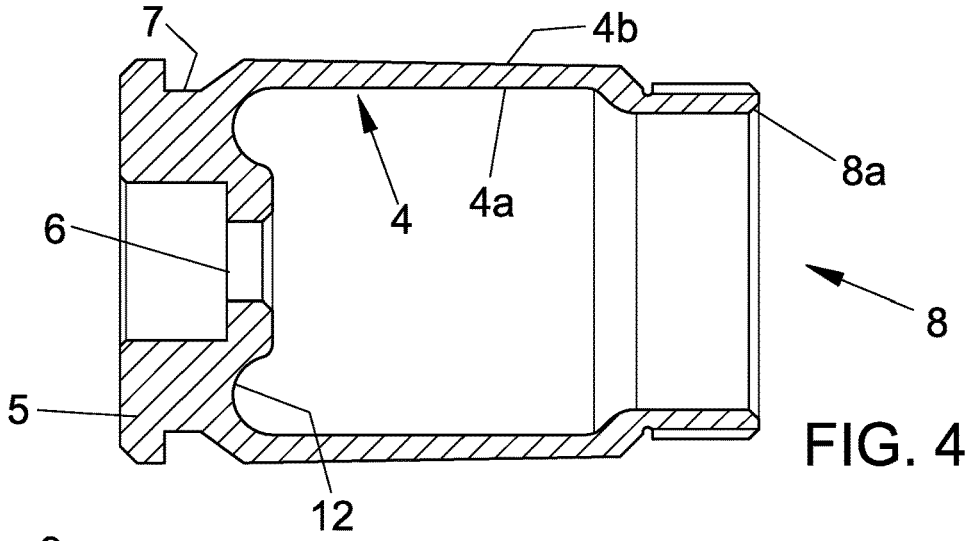
FIG. 4 shows an axial sectional view of the rear element.
Figure 5:
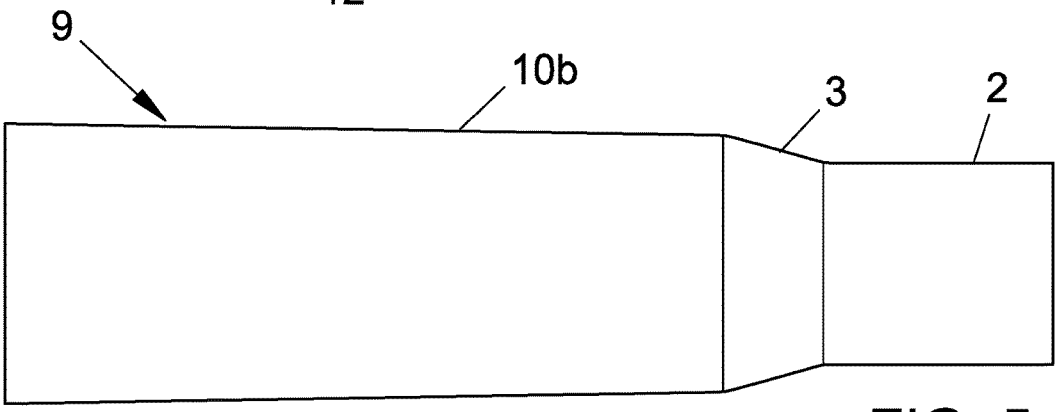
FIG. 5 shows a side elevation view of the front element.
Figure 6:
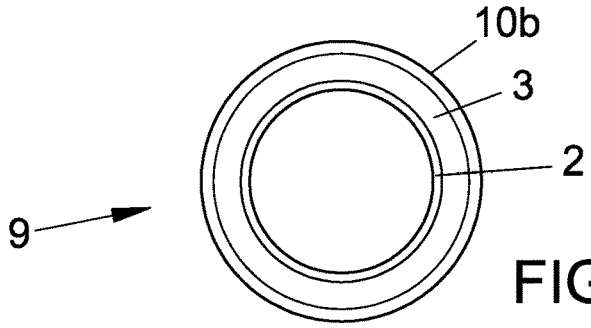
FIG. 6 shows a plan view of the front element.
Figure 7:
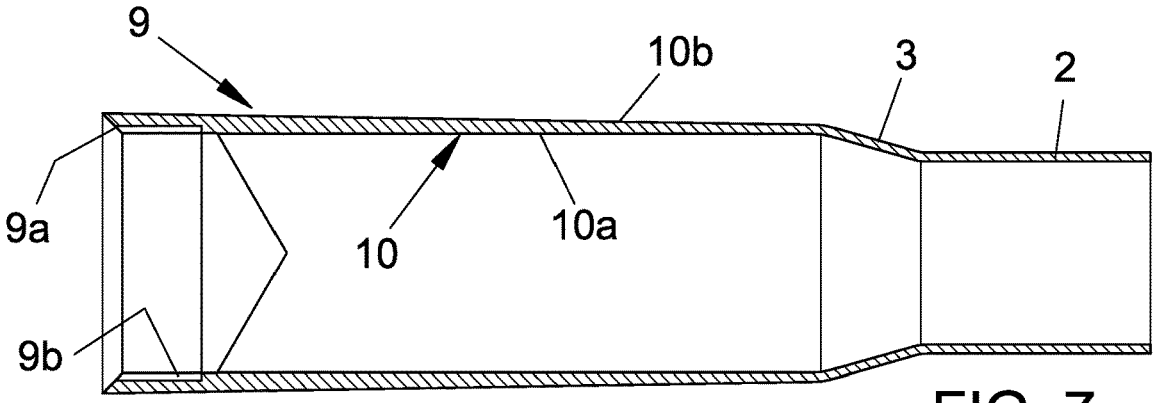
FIG. 7 shows an axial sectional view of the front element.

With reference to the above-mentioned figures, a metal cartridge for ammunition denoted in its entirety by the reference number 1 is shown.

The cartridge 1 can be used, in particular, for artillery or antiaircraft or anti-tank rifle ammunition.

The cartridge 1 has a front retaining collar 2 for retaining a projectile (not shown) and a hollow body 4, 10 having an internal surface that bounds a chamber 11 of the propellent.

The hollow body 4, 10 has a rim 5 at the rear provided with a central primer hole 6 and at the front a shoulder 3 connecting to the collar 2.

The hollow body 4, 10 has a lateral wall that is thicker towards the rim 5, in order to better withstand the pressure of the propellent, and thinner towards the collar 2. The rim 5, in turn, has a perimeter groove 7 externally that serves as a hold for the extractor.

Advantageously, the cartridge 1 is formed by a rear element 8 and a front element 9 that are structurally independent and fixed stiffly to one another.

Advantageously, in order to make the cartridge 1, a light alloy is used, preferably an aluminum alloy, susceptible to mechanical removal of chips.

The rear element 8 has a lowered front end 8*a*, on top of which there is a rear end 9*a* of the front element 9.

The lowered front end 8*a* of the rear element 8 has an external thread 8*b* screwed to an internal counter-thread 9*b* of the rear end 9*a* of the front element 9.

The rear element 8 includes the rim 5 and a rear portion 4 of the body 4, 10 in turn including the externally threaded front end 8*a*.

The front element 9 includes instead the shoulder 2, the collar 3 and a rear portion 10 of the body 4, 10 in turn including the internally counter-threaded rear end 9*a*.

The rear portion 4 of the body 4, 10 and the front portion 10 of the body 4, 10 are juxtaposed flush with one another in the outer side of the junction part thereof.

The choice of forming the cartridge in two distinct and structurally independent parts increases the design choices for optimizing the internal volume of the chamber of the propellent 11.

In this regard, the internal surface of the chamber of the propellent 11 advantageously has, at the rim 5, at least one notch 12 configured to increase the volume of the chamber of the propellent 11.

The notch 12 extends perimetrally to the central primer hole 6.

In particular, the notch 12 extends longitudinally along a circumference having its center in the central primer hole 6.

The notch 12, finally, extends transversally along a semi-circumference that preferably has a diameter approximately equal to the diameter of the primer hole 6. The inner side of the rim 5 can obviously have one or more recesses of another shape, size and position to increase the internal volume of the chamber of the propellent 11.

Thanks to the possibility of making each element 8, 9 separately by mechanical removal of chips, the design options for increasing the internal volume of the chamber of the propellent 11 are considerably expanded.

For example, it is possible to shape the body 4, 10 with a cylindrical internal surface or a calibrated conicity even opposite the one typically adopted for the known cartridges to facilitate the extraction of the punch from the die.

The thickness of the wall of the cartridge 1 is controlled by grinding both the internal surface and external surface thereof.

In the case illustrated, the thinning of the wall of the body 4, 10 in the direction that goes from the rim 5 to the shoulder 3 is obtained by forming the body 4, 10 with a cylindrical internal surface 4*a*, 10*a* and a slightly conical external surface 4*b*, 10*b*, for example with a conicity of 1°.

However, it is not excluded that, as noted, the internal surface 4*a*, 10*a* of the body 4, 10 may have in turn a conical conformation, so that the inner lumen of the body 4, 10 widens progressively in the axial direction that goes from the shoulder 3 to the rim 5.

Moreover, it is not excluded that, as noted, the internal surface 4*a*, 10*a* of the body 4, 10 may have in part a cylindrical conformation and in part a conical conformation so that only for a certain length of the body 4, 10, the inner lumen of the body 4, 10 widens progressively in the axial direction that goes from the shoulder 3 to the rim 5.

In particular, the internal surface 4*a* of the rear portion 4 of the body 4, 10 can have a cylindrical conformation and the internal surface of the front portion 10 of the body 4, 10 can have a conical conformation or vice-versa.

As noted, the cartridge 1 is produced by mechanical removal of chips.

In particular, use is made of a solid light alloy rod which is machined on a lathe to form the rear element 8 of the cartridge 1 and an axially hollow light alloy rod, preferably made of the same material, which is machined on a lathe to form the front element 9 of the cartridge 1.

The rods are subjected to an initial rough machining to remove most of the excess metal followed by finishing to obtain a final surface with the desired properties.

The light alloy used, in addition to being susceptible to mechanical removal of chips, must have the necessary mechanical and chemical characteristics.

For this reason, an aluminum alloy, ERGAL™, has been adopted as the preferred choice, in particular a light alloy ERGAL™ 7075 used in aeronautics, which exhibits excellent characteristics of mechanical strength and resistance to attack by acids, solvents and lubricants combined with an exceptional machinability by removal of chips.

Mechanical removal of chips is preferably performed on a sliding head lathe.

In order to produce the rear element 8, the solid rod is internally and externally machined so as to form both the rear portion 4 of the body 4, 10 with the lowered front end 4*a* and the rim 5 with the primer hole 6, the internal notch 12 and the external perimeter groove 7.

In order to produce the front element 9, the hollow rod is internally and externally machined so as to form both the front portion 10 of the body 4, 10, and the shoulder 3 as well as the collar 2.

The cartridge for ammunition and the method of making it thus conceived are susceptible to numerous modifications and variants, all falling within the scope of the inventive concept; moreover, all details may be replaced with technically equivalent elements.

The materials used, as well as the dimensions, may in practice be of any type, according to needs and the state of the art.

The invention claimed is:

1. A metal cartridge for ammunition comprising:

a front retaining collar retaining a projectile and a hollow body comprising a rim at the rear provided with a central primer hole and at the front a shoulder connecting to said collar, said hollow body comprising an internal surface that bounds a chamber of a propellent, and formed by a rear element and a front element that are structurally independent, fixed stiffly to one another, and in that said internal surface has adjacent to said rim at least one notch configured to increase the volume of said chamber of the propellent, wherein said notch extends longitudinally around said central primer hole, wherein said rear element has a lowered externally threaded front end screwed to an internally counter-threaded rear end of said front element, wherein said rear element includes said rim and a rear portion of said body in turn including said externally threaded front end, and said front element includes said shoulder, said collar and a front portion of said body in turn including said internally counter-threaded rear end, wherein the metal cartridge is made of aluminum alloy, and wherein the rear portion of said body has an internal cylindrical or conical surface placing said lowered externally threaded front end at an axial distance in front of the central primer hole.

2. A method of making a cartridge for ammunition according to claim 1, characterized in subjecting two alloy rods to mechanical removal of chips so as to form said rear element of the cartridge and said front element of the cartridge.

3. The method of making a cartridge for ammunition according to claim 2, characterized in that said two alloy rods are machined internally and externally.

4. The method of making a cartridge for ammunition according to claim 2, wherein a solid rod is used to form the rear element and an axially hollow rod to form the front element.

* * * * *